US006435168B1

(12) United States Patent
Bircann et al.

(10) Patent No.: US 6,435,168 B1
(45) Date of Patent: Aug. 20, 2002

(54) PRESSURE BALANCING METERING SUBASSEMBLY FOR USE WITH A MODULAR EGR VALVE

(75) Inventors: Raul A. Bircann, Penfield; Dwight O. Palmer, Rochester, both of NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/721,225

(22) Filed: Nov. 22, 2000

Related U.S. Application Data

(60) Provisional application No. 60/184,530, filed on Feb. 24, 2000.

(51) Int. Cl.[7] ..... F02M 25/07

(52) U.S. Cl. ..... 123/568.21; 251/129.07

(58) Field of Search ..... 123/568.11, 568.21, 123/568.26, 568.27, 568.29; 251/129.07, 129.15, 282

(56) References Cited

U.S. PATENT DOCUMENTS 6,178,956 B1 * 1/2001 Steinmann et al. .... 123/568.21
6,217,001 B1 * 4/2001 Gluchowski et al. .. 251/129.07

* cited by examiner

*Primary Examiner*—Willis R. Wolfe
(74) *Attorney, Agent, or Firm*—John Van Ophem

(57) ABSTRACT

A pressure balancing metering subassembly for use with a modular actuator of an EGR valve includes a metering base which defines a metering port and a pressure chamber. An elongate poppet includes a first end normally disposed in sealing engagement with the metering port. The poppet is selectively reciprocated to disengage the first end from sealing engagement with the metering port to thereby fluidly connect the metering port with the pressure chamber. Pressure balancing means balance the pressure at the first end of the poppet with the pressure at a second end of the poppet.

2 Claims, 3 Drawing Sheets

PRESSURE BALANCING METERING SUBASSEMBLY FOR USE WITH A MODULAR EGR VALVE

CROSS-REFERENCE TO RELATED APPLICATIONS

This application claims the benefit of U.S. Provisional Patent Application Ser. No. 60/184,530, filed Feb. 24, 2000.

TECHNICAL FIELD

The present invention relates to exhaust gas recirculation valves for use with internal combustion engines.

BACKGROUND OF THE INVENTION

Exhaust gas recirculation (EGR) valves capture engine exhaust and recycle at least a portion of that captured exhaust gas into the combustion chamber of the engine to improve combustion. Exhaust gas is used since it is readily available and contains only a small amount of oxygen. Adding the exhaust gas to the air in the combustion chamber has the effect of lowering the combustion temperature below the point at which nitrogen combines with oxygen. Thus, exhaust gas recirculation increases fuel economy and reduces the level of undesirable emissions.

Conventional EGR valves include an actuator and a metering base. The metering base includes a metering chamber having a metering port. The metering chamber has an end that is associated with the intake manifold or intake vacuum of the engine. The metering port is connected to a source of exhaust gas and provides a passageway for the flow of exhaust gas into the metering chamber. An elongate shaft extends contiguously in a longitudinal direction from the actuator, through an orifice in the metering base, into the metering chamber, and to the metering port. A metering poppet, which is a plunger-shaped member, is disposed at the end of the shaft proximate to the metering port. In a default position, the metering poppet abuttingly engages or is disposed within the metering port, thereby sealing the metering port. In this default position, no exhaust gas enters the metering chamber through the metering port. The shaft is reciprocated to displace the metering poppet from engagement with the metering port thereby unsealing the metering port and allowing exhaust gas to flow through the metering port into the metering chamber and into the intake manifold of the engine. Thus, the reciprocal motion of the shaft and metering poppet selectively control the flow of exhaust gas into the intake air stream of the engine.

Automotive engines operate under relatively high exhaust backpressure and pressure pulsations. These conditions of high backpressure and pressure pulsations can interfere with the operation of conventional EGR valves. The high amplitude pulsations can render the EGR valve uncontrollable by interfering with the motion of the shaft as the metering poppet comes into and out of sealing engagement with the metering port. Furthermore, the high amplitude pulsations increase the air loading on the relatively large surface area of the metering poppet. The increased air loading on the metering poppet increases the force necessary to reciprocate the shaft. The actuator must be designed to produce enough force to reciprocate the shaft under these conditions of high-amplitude pressure pulsations and increased air loading on the metering poppet. Thus, the actuator must be designed to produce more power than would be required to reciprocate the shaft absent the pressure pulsations and high back pressure. Automotive manufacturers are continually striving to decrease the cost, size and weight of components in order to conserve valuable and cramped engine compartment space, to decrease vehicle cost, and to decrease the overall weight of vehicles in the interest of fuel economy. An actuator that produces higher force comes with the undesirable consequences of increased size, weight, and cost.

In striving to increase fuel economy, automotive manufacturers have produced engines which are intended to operate using higher proportions of recirculated exhaust gas in their combustion air charge. Some automobile engines are designed to operate with as much as fifteen-percent of their intake air stream composed of recirculated exhaust gas. This demand for a higher flow rate of recirculated exhaust gas, in turn, demands a higher flow rate of exhaust gas through the EGR valve. The demand for a higher flow rate of exhaust gas places a corresponding demand on the actuator of the EGR valve. In order to meet this demand for a higher flow rate, a more powerful actuator typically must be used, thereby incurring the undesirable consequences of an actuator having increased size, weight and cost.

Therefore, what is needed in the art is an EGR valve which is resistant to the pressure pulsations and high backpressure.

Furthermore, what is needed in the art is an EGR valve which produces a high flow rate without requiring a large, high-force actuator.

Moreover, what is needed in the art is an EGR valve having a modular design and construction.

SUMMARY OF THE INVENTION

The present invention provides a pressure balancing metering subassembly for use with an actuator of a modular EGR valve.

The invention comprises, in one form thereof, a metering base having a metering port and a metering chamber. An elongate poppet includes a first end normally disposed in sealing engagement with the metering port. The poppet is selectively reciprocated to disengage the first end from sealing engagement with the metering port to thereby fluidly connect the metering port with the metering chamber. Pressure balancing means balance a pressure at the first end of the poppet with a pressure at a second end of the poppet.

An advantage of the present invention is that the effect of backpressure, pressure fluctuations, and pressure differentials upon reciprocation of the poppet is reduced.

Yet another advantage of the present invention is that less force will be required to reciprocate the poppet.

A still further advantage of the present invention is that less power will be required from an actuator to reciprocate the poppet.

An even further advantage of the present invention is that it can be coupled to an actuator to form a modular EGR valve.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENT

Figure 1:
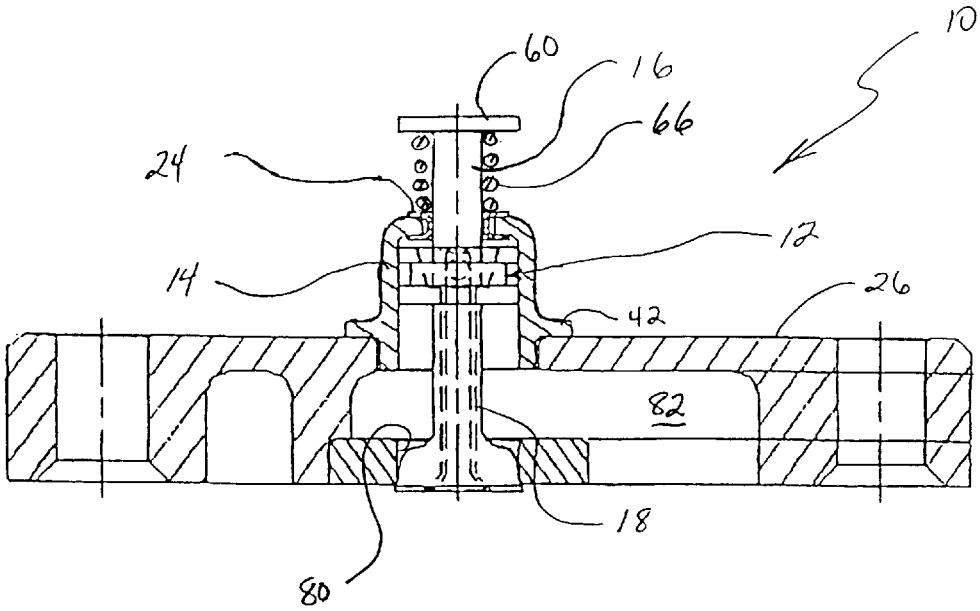
FIG. 1 is a partially sectioned view of one embodiment of a pressure balancing metering subassembly of the present invention.

With reference to the Figures, and particularly to FIG. 1, there is shown one embodiment of a modular pressure balancing metering subassembly of the present invention. Pressure balancing metering subassembly (PBMS) 10 includes piston 12, cylinder 14, elongate shaft 16, elongate poppet 18, seal 24 and base 26.

Figure 2:
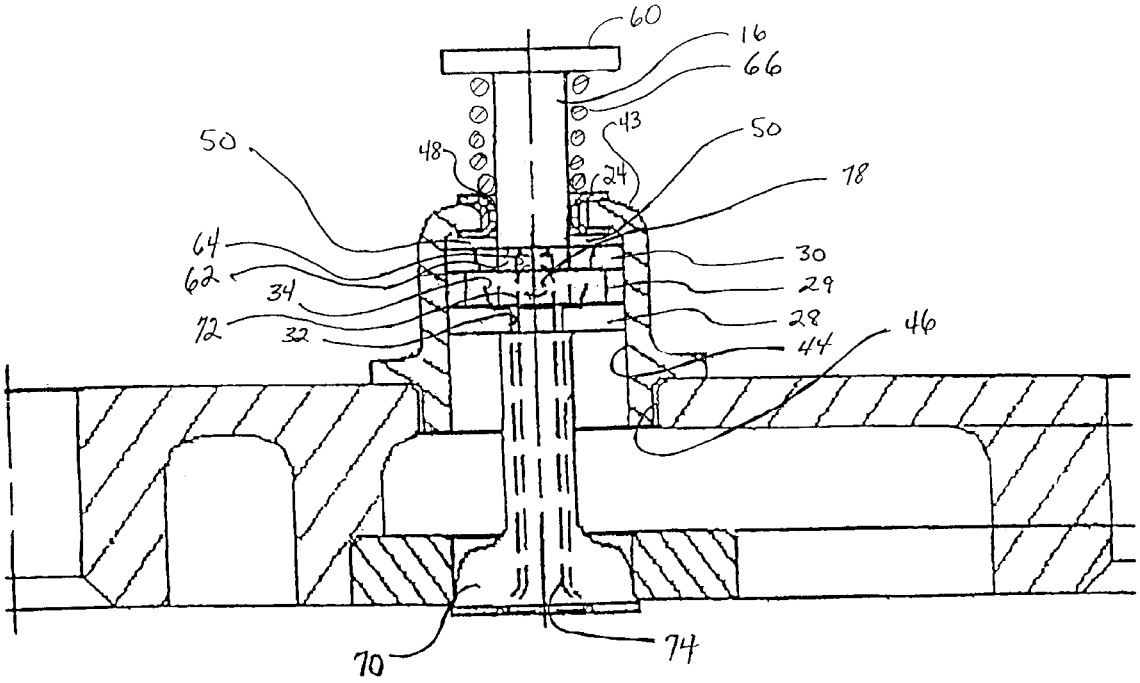
FIG. 2 is an enlarged partially-sectioned view of the cylinder and piston of the pressure balancing metering subassembly of FIG. 1.

Piston 12 is disposed within cylinder 14. As best shown in FIG. 2, piston 12 includes bottom surface 28 interconnected by cylindrical sidewall 29 to top surface 30. Bottom surface 28 is substantially cylindrical and is disposed around a bottom of sidewall 29. Top surface 30 is substantially cylindrical and disposed around a top of sidewall 29. Bottom surface 28 defines piston orifice 32. Piston 12 defines a conical inner surface 34 which tapers outwardly from bottom surface 28 to top surface 30. Piston orifice 32 extends axially through bottom surface 28, terminating at and opening into inner surface 34.

Cylinder 14 is a cup-shaped member and includes a radially outward extending flange 42, top 43 and inner wall 44. Cylinder 14 is received substantially concentrically within bore 46 of base 26 until flange 42 contacts and seats upon base 26. Top 43 defines a shaft orifice 48 within which bearing seal 24 is disposed. Bottom surface 28 of piston 12 circumferentially engages inner wall 44 of cylinder 14 in an air and fluid tight manner. Top surface 30 of piston 12 circumferentially engages inner wall 44 of cylinder 14 proximate top 43 in an air and fluid tight manner. Pressure chamber 50 is defined between top surface 30, inner surface 34 of piston 12, inner wall 44 and top 43 of cylinder 14.

Elongate shaft 16 includes a first end with a radially-outward extending shaft flange 60. Elongate shaft 16 extends axially from shaft flange 60 concentrically through bearing seal 24 and into pressure chamber 50. Bearing seal 24 is configured to seal shaft 16 and shaft orifice 48 in an air and fluid tight manner. Bearing seal 24 maintains this air and fluid tight interface between shaft 16 and shaft orifice 48 during reciprocal movement of shaft 16. Second end 62 of elongate shaft 16 is reciprocally disposed within pressure chamber 50 and defines an axial bore 64 therein. Spring 66 has one end disposed in engagement with flange 60 of elongate shaft 16, and the other end disposed in engagement with bearing seal 24. Spring 66 exerts an axially-directed force on each of flange 60 and bearing seal 24, thereby maintaining seal 24 in sealing disposition within shaft orifice 48 and biasing shaft 16 in a direction away from base 26.

Elongate poppet 18 includes a plunger-shaped end 70 interconnected with a narrowed stem end 72 at its opposite end, and defines an axially extending cavity 74 therethrough. Stem end 72 extends through piston orifice 32 and is disposed within pressure chamber 50. Bottom surface 28 of piston 12 is tightly seated upon and engages poppet 18 in an air and fluid tight manner. Stem end 72 is received within axial bore 64 of and/or coupled to elongate shaft 16. Thus, reciprocation of poppet shaft 16 will, in turn, reciprocate poppet 18. Stem end 72 defines a radial orifice 78 which intersects cavity 74 thereby fluidly connecting cavity 74 with pressure chamber 50. Axial cavity 74 provides a passageway through which air flows from the area proximate plunger end 70 of elongate poppet 18 and into pressure chamber 50.

Bearing seal 24 is disposed within shaft orifice 48 of cylinder 14. Elongate shaft 16 passes through bearing seal 24. Bearing seal 24 surrounds elongate shaft 16 in an air and fluid tight manner, thereby sealing pressure chamber 32. Bearing seal 24 maintains this seal during the reciprocal motion of elongate shaft 16 therein.

Base 26 defines a metering port 80 (FIG. 3) and metering chamber 82. Metering port 80 is connected to a source of exhaust gas (not shown). Elongate poppet 18 extends through metering port 80. Plunger end 70 of elongate poppet 18 is disposed proximate to and is configured to sealingly engage metering port 80. Reciprocal motion of elongate shaft 16 is transferred to elongate poppet 18. Such reciprocal motion will bring plunger end 70 of elongate poppet 18 into and out of sealing engagement with metering port 80, thereby selectively opening and closing metering port 80. Plunger end 70 in a default position is disposed in sealing engagement with metering port 80, thereby preventing any flow of exhaust gas into metering chamber 82. Elongate poppet 18 is selectively reciprocated out of sealing engagement with metering port 80 to allow exhaust gas to flow therethrough and into metering chamber 82. Base 26 further includes mounting bores 86*a* and 86*b*.

Figure 3:
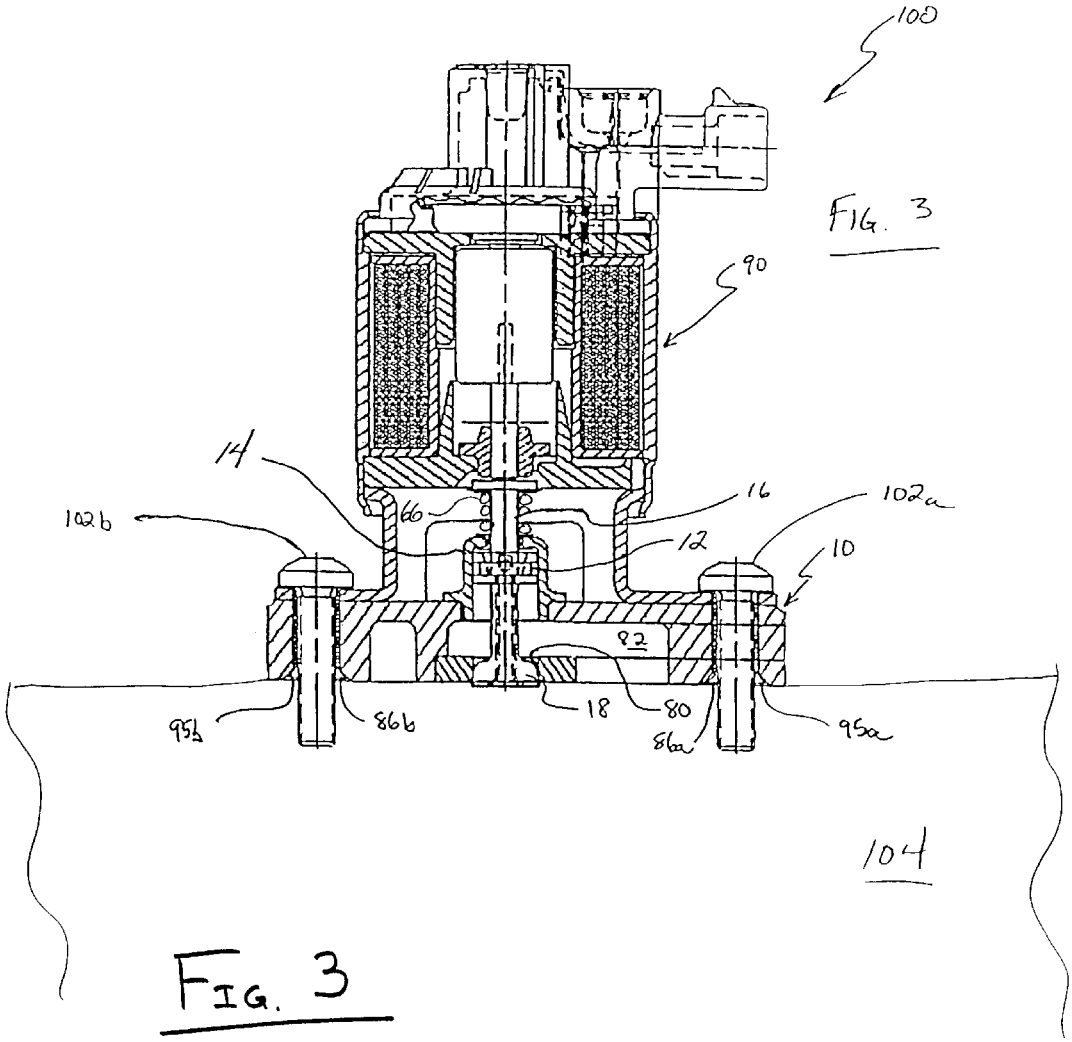
FIG. 3 is a partially sectioned view of the pressure balancing metering subassembly of FIG. 1 coupled to an actuator subassembly.

Referring now to FIG. 3, modular EGR valve 100 includes pressure balanced metering subassembly (PBMS) 10 and modular actuator subassembly 90. Actuator subassembly 90 is coupled to PBMS 10 and selectively reciprocates elongate shaft 16 of PBMS 10 which, in turn, reciprocates plunger end 70 of elongate poppet 18 into and out of sealing engagement with metering port 80. Thus, exhaust gas is selectively allowed to flow through metering port 80 and into metering chamber 82. Fasteners, such as, for example, eyelets 95*a* and 95*b* are used to couple PBMS 10 to actuator subassembly 90. Fasteners such as, for example, bolts 102*a* and 102*b* are used to couple the modular EGR valve 100 to engine 104.

In use, (PBMS) 10 is coupled to actuator subassembly 90, which is configured to selectively reciprocate elongate shaft 16 and, in turn, elongate poppet 18, thereby sealing and unsealing metering port 80. Exhaust gas will exert a pressure against plunger end 70 of elongate poppet 18. This pressure will include pulsations between a high pressure and a lower pressure. Any pressure and transient pressure surges in the area proximate plunger 70 will be transferred into pressure chamber 50 through cavity 74, thereby equalizing the pressure acting on plunger 70 with the pressure in pressure chamber 50. The same pressure acting upon plunger 70 acts upon inner surface 34 of piston 12. Therefore, reciprocation of elongate shaft 16 and, in turn, elongate poppet 18 is accomplished without requiring the force necessary to overcome the back pressure and pressure pulsations present at plunger 70.

The effect of pressure pulsations present at plunger 70, and/or the pressure differential between plunger 70 and stem end 72 of poppet 18, are reduced by fluidly connecting pressure chamber 50 with the pressure present in metering port 80 via cavity 74 of poppet 18. By making the surface area of conical inner surface 34 of piston 12 substantially equal to the surface area of plunger 70, the forces exerted upon poppet 18 by the pressures present in metering port 80 and pressure chamber 50 will substantially cancel each other. Thus, reciprocation of poppet 18 is rendered substantially immune from pressure differentials and/or pressure fluctuations at metering port 80 and the force required to reciprocate poppet 18 is substantially reduced.

In the embodiment shown, PBMS 10 is coupled to actuator subassembly 90. However, it is to be understood that PBSM 10 can be alternately configured to be coupled or otherwise operably associated with a variously configured actuator subassemblies.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A pressure balancing metering subassembly for use with a modular actuator of an EGR valve, said pressure balancing metering subassembly comprising:

a metering base defining a metering port and a metering chamber;

an elongate poppet having a first end and a second end, said first end normally disposed in sealing engagement with said metering port, said poppet being selectively reciprocated to disengage said first end from sealing engagement with said metering port to thereby fluidly connect said metering port with said metering chamber; and pressure balancing means balancing a pressure at said first end of said poppet with a pressure at said second end of said poppet, said pressure balancing means comprising:

a cylinder having a top and a cylindrical sidewall;

a piston disposed within said cylinder, said piston sealingly engaging an inner surface of said cylindrical sidewall of said cylinder, a pressure chamber being defined between said piston, said cylindrical sidewall and said to top of said cylinder, said second end of said poppet being disposed within said pressure chamber, said piston being one of in abutting engagement with and coupled to said poppet; and an axial cavity defined by said poppet, said axial cavity extending from said first end to said second end to thereby place said pressure chamber into fluid communication with said metering port;

wherein said piston comprises a substantially cylindrical piston wall, a top surface and a bottom surface, said top surface and said bottom surface being interconnected by said piston wall, a conical inner surface disposed between said bottom surface and said top surface, said bottom surface defining an orifice therethrough, said orifice extending from said bottom surface to said conical inner surface, said piston sealingly engaging an inner surface of said sidewall of said cylinder, said pressure chamber conjunctively defined by said top surface of said piston, said inner surface of said piston, a portion of said inner surface of said sidewall of said cylinder, and said top of said cylinder, said poppet extending through said orifice to thereby dispose said second end of said poppet within said pressure chamber.

2. The pressure balancing metering subassembly of claim 1, wherein said conical inner surface of said piston has a first surface area, said first end of said metering poppet having a second surface area, said first surface area being substantially equal to said second surface area.

* * * * *